US011639724B2

(12) United States Patent
Kim

(10) Patent No.: US 11,639,724 B2
(45) **Date of Patent: *May 2, 2023**

(54) TURBO COMPRESSOR HAVING SEPARATE COOLING AIR CHANNEL

(71) Applicant: TNE KOREA CO., LTD., Daejeon (KR)

(72) Inventor: Kyeong Su Kim, Daejeon (KR)

(73) Assignee: TNE KOREA CO., LTD., Daejeon (KR)

( * ) Notice: Subject to any disclaimer, the term of this patent is extended or adjusted under 35 U.S.C. 154(b) by 515 days.

This patent is subject to a terminal disclaimer.

(21) Appl. No.: 16/348,552

(22) PCT Filed: Nov. 7, 2017

(86) PCT No.: PCT/KR2017/012555
§ 371 (c)(1),
(2) Date: May 9, 2019

(87) PCT Pub. No.: WO2018/088778
PCT Pub. Date: May 17, 2018

(65) Prior Publication Data

US 2019/0293085 A1 Sep. 26, 2019

(30) Foreign Application Priority Data

Nov. 14, 2016 (KR) ..... 10-2016-0151311

(51) Int. Cl.
*F04D 29/42* (2006.01)
*F04D 29/28* (2006.01)
(Continued)

(52) U.S. Cl.
CPC ..... *F04D 29/4206* (2013.01); *F04D 29/28* (2013.01); *F04D 29/284* (2013.01);
(Continued)

(58) Field of Classification Search
CPC ..... F04D 29/5806; F04D 29/584; F04D 29/5813; F04D 29/082; F04D 29/4206;
(Continued)

(56) References Cited

U.S. PATENT DOCUMENTS 3,089,969 A * 5/1963 Wiedemann ..... H02K 9/197 310/53
4,125,345 A * 11/1978 Yoshinaga ..... F04D 17/12 415/179
(Continued)

FOREIGN PATENT DOCUMENTS

CN 103326512 A 9/2013
KR 10-2013-0030392 A 3/2013
(Continued)

*Primary Examiner* — Eldon T Brockman
*Assistant Examiner* — Maxime M Adjagbe
(74) *Attorney, Agent, or Firm* — Korus Patent, LLC; Seong Il Jeong

(57) ABSTRACT

Provided is a turbo compressor for compressing a gas such as air and supplying the compressed gas to outside, the turbo compressor including a compression unit including a compression gas inlet for sucking the gas, an impeller for compressing the gas sucked through the compression gas inlet, a compression gas outlet for discharging the gas compressed by the impeller, and a compression gas channel connected from the compression gas inlet to the compression gas outlet, a motor including a rotary shaft having a front end coupled to the impeller, to rotate the impeller, a housing having a motor accommodation space to accommodate the motor, and a cooling gas channel passing through the motor accommodation space and enabling circulation of a cooling gas contained therein, wherein the compression gas channel is spatially separate from the cooling gas channel and thus the gas in the compression gas channel does not permeate into the cooling gas channel.
(Continued)

According to the present invention, the motor may be efficiently cooled without pressure loss of the compression unit.

1 Claim, 10 Drawing Sheets

(51) Int. Cl.
*F04D 29/44* (2006.01)
*F04D 29/58* (2006.01)

(52) U.S. Cl.
CPC ..... *F04D 29/42* (2013.01); *F04D 29/44* (2013.01); *F04D 29/58* (2013.01); *F04D 29/5826* (2013.01)

(58) Field of Classification Search
CPC ..... F04D 29/42; F04D 29/28; F04D 29/58; F04D 29/284; F04D 29/44; F04D 29/5826; F04D 25/06; F04D 29/582
See application file for complete search history.

(56) References Cited

U.S. PATENT DOCUMENTS 4,688,383 A * 8/1987 Targa Pascual ..... F01P 3/20 60/599
6,183,208 B1 * 2/2001 Qandil ..... F04D 13/08 417/201
6,700,237 B1 * 3/2004 Yang ..... H02K 9/10 310/58
7,063,519 B2 * 6/2006 Agrawal ..... F04D 29/057 417/365
7,193,342 B2 * 3/2007 Casey ..... H02K 1/20 310/54
7,633,193 B2 * 12/2009 Masoudipour ..... F04D 29/5806 310/54
7,670,118 B2 * 3/2010 Sato ..... H01M 8/04014 417/420
9,863,430 B2 * 1/2018 Lee ..... F04D 25/082
10,072,667 B2 * 9/2018 An ..... F04D 29/056
11,009,043 B2 * 5/2021 Kim ..... F04D 29/584
2009/0261668 A1 * 10/2009 Mantere ..... H02K 5/20 310/54
2012/0207585 A1 * 8/2012 Anderson ..... F04D 25/06 415/116
2014/0127050 A1 * 5/2014 Oda ..... H02K 9/19 417/368
2015/0097450 A1 * 4/2015 Xu ..... F04D 13/06 310/54

FOREIGN PATENT DOCUMENTS

KR 10-2013-0139076 A 12/2013
KR 10-2015-0007755 A 1/2015
KR 10-2016-0014376 A 2/2016

* cited by examiner

TURBO COMPRESSOR HAVING SEPARATE COOLING AIR CHANNEL

TECHNICAL FIELD

The present invention relates to a turbo compressor and, more particularly, to a turbo compressor capable of efficiently cooling a motor without pressure loss of a compression unit.

BACKGROUND ART

Turbo compressors or turbo blowers are centrifugal pumps for sucking in external air or a gas, compressing the air or gas, and then providing the compressed air or gas to outside by rotating an impeller at a high speed, and are commonly used to pneumatically convey powder or for aeration at sewage treatment plants, etc. and are also currently used for industrial processes and for vehicles.

In the turbo compressors, generation of high heat is unavoidable because of friction between a motor and bearings due to high-speed rotation of the impeller. Major heat sources such as the motor and the bearings need to be cooled.

An example of general turbo compressors is disclosed in Korean Patent Publication No. 10-2015-0007755. In this general turbo compressor, a part of air compressed by an impeller is used to cool a motor and bearings for rotating the impeller, and then is supplied again to the impeller through a hole in a rotary shaft of the motor.

Although the configuration of a cooling system may be simplified, the general turbo compressor uses a part of the air compressed by the impeller, as a cooling gas and thus pressure loss occurs in the air compressed by the impeller.

Furthermore, in the general turbo compressor, since the cooling gas is heated by the motor and the bearings and then is supplied again to the impeller, the temperature of the air to be compressed by the impeller is increased and thus compression efficiency of the turbo compressor is additionally reduced.

DETAILED DESCRIPTION OF THE INVENTION

Technical Problem

The present invention provides a turbo compressor capable of efficiently cooling a motor without pressure loss of a compression unit.

Technical Solution

According to an aspect of the present invention, there is provided a turbo compressor for compressing a gas such as air and supplying the compressed gas to outside, the turbo compressor including a compression unit including a compression gas inlet for sucking the gas, an impeller for compressing the gas sucked through the compression gas inlet, a compression gas outlet for discharging the gas compressed by the impeller, and a compression gas channel connected from the compression gas inlet to the compression gas outlet, a motor including a rotary shaft having a front end coupled to the impeller, to rotate the impeller, a housing having a motor accommodation space to accommodate the motor, and a cooling gas channel passing through the motor accommodation space and enabling circulation of a cooling gas contained therein, wherein the compression gas channel is spatially separate from the cooling gas channel and thus the gas in the compression gas channel does not permeate into the cooling gas channel.

The cooling gas channel may include gas channels penetrating through the housing to cool the housing.

The turbo compressor may further include a cooling fan for circulating the cooling gas contained in the cooling gas channel.

The cooling fan may be provided at a rear end of the rotary shaft and is rotated by rotational force of the rotary shaft.

The turbo compressor may further include a cooling water channel for enabling circulation of a cooling liquid therein.

The cooling water channel may include water channels penetrating through the housing to cool the housing.

The cooling water channel may be configured to exchange heat with the cooling gas contained in the cooling gas channel.

The cooling gas channel may include gas channels penetrating through the housing to cool the housing, and the gas channels penetrating through the housing and the water channels penetrating through the housing may extend along a length direction of the rotary shaft and be alternately arranged along a circumferential direction of the rotary shaft.

Cooling fins capable of increasing heat exchange efficiency may be provided between the cooling water channel and the cooling gas channel.

The housing may include an inner housing having the motor accommodation space, and an outer housing surrounding the inner housing, and the cooling gas channel may be provided between an outer surface of the inner housing and an inner surface of the outer housing.

Advantageous Effects of the Invention

According to the present invention, using a turbo compressor including a compression unit including a compression gas inlet for sucking a gas, an impeller for compressing the gas sucked through the compression gas inlet, a compression gas outlet for discharging the gas compressed by the impeller, and a compression gas channel connected from the compression gas inlet to the compression gas outlet, a motor including a rotary shaft having a front end coupled to the impeller, to rotate the impeller, a housing having a motor accommodation space to accommodate the motor, and a cooling gas channel passing through the motor accommodation space and enabling circulation of a cooling gas contained therein, since the compression gas channel is spatially separate from the cooling gas channel and thus the gas in the compression gas channel does not permeate into the cooling gas channel, the motor may be efficiently cooled without pressure loss of the compression unit.

BEST MODE

Hereinafter, the present invention will be described in detail by explaining embodiments of the invention with reference to the attached drawings.

Figure 1:
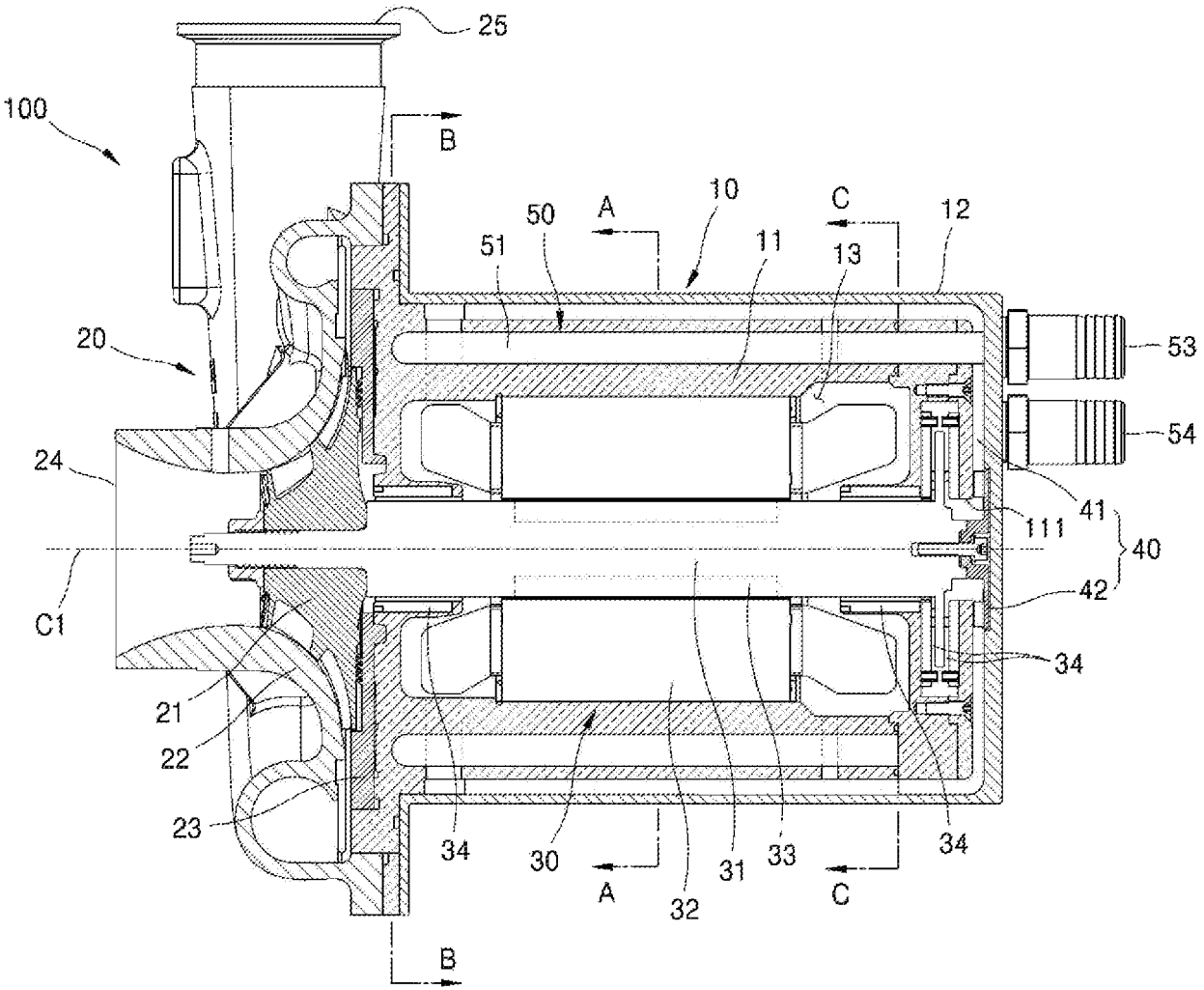
FIG. 1 is a cross-sectional view of a turbo compressor according to an embodiment of the present invention.
Figure 2:
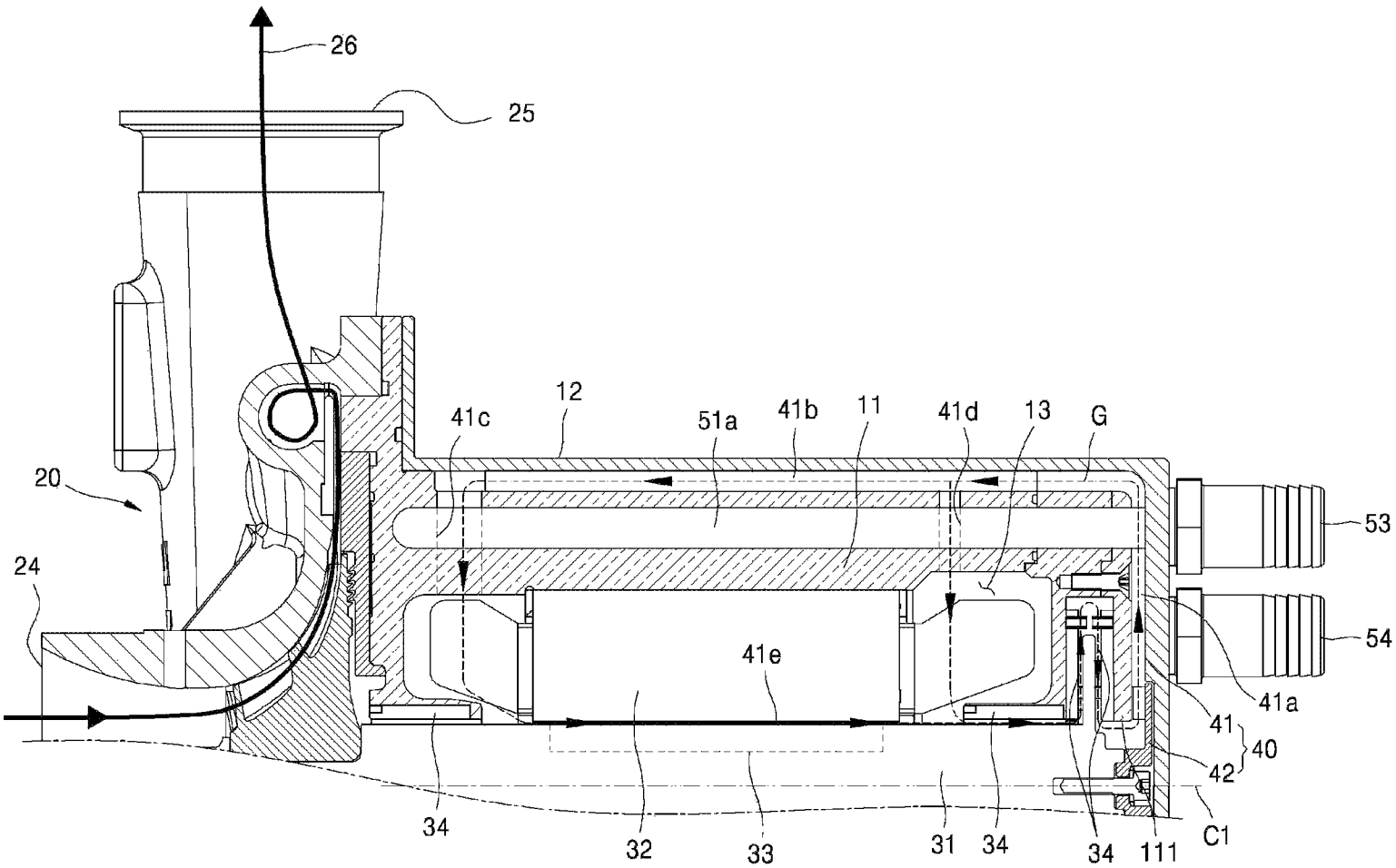
FIG. 2 is a magnified cross-sectional view of a part of the turbo compressor illustrated in FIG. 1.
Figure 3:
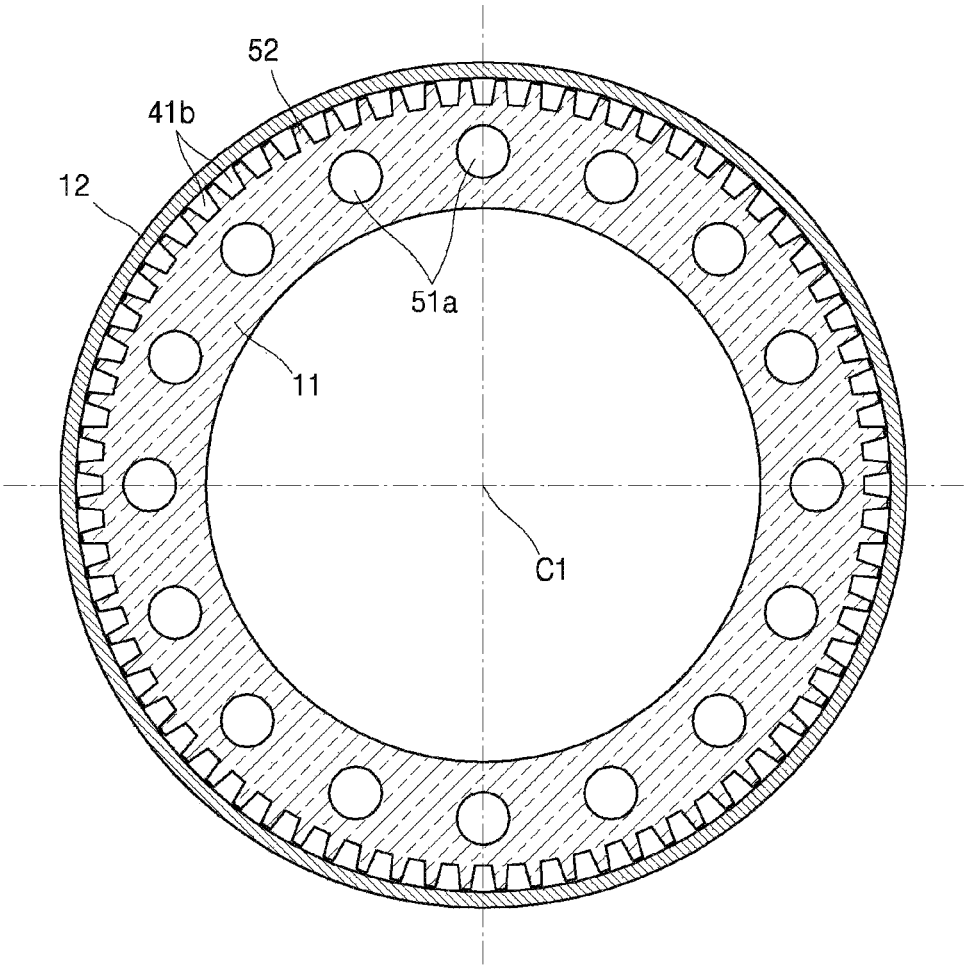
FIG. 3 is a cross-sectional view of the turbo compressor cut along line A-A of FIG. 1.

FIG. 1 is a cross-sectional view of a turbo compressor 100 according to an embodiment of the present invention, and FIG. 2 is a magnified cross-sectional view of a part of the turbo compressor 100 illustrated in FIG. 1. FIG. 3 is a cross-sectional view of the turbo compressor 100 cut along line A-A of FIG. 1.

Referring to FIGS. 1 to 3, the turbo compressor 100 according to an embodiment of the present invention is a centrifugal pump for sucking in an external gas, compressing the gas, and then providing the compressed gas to outside by rotating an impeller at a high speed, and is also called a turbo compressor or a turbo blower. The turbo compressor 100 includes a housing 10, a compression unit 20, a motor 30, an air-cooling unit 40, and a water-cooling unit 50. In the following description, the gas to be compressed is assumed as air.

The housing 10 is a metal housing and includes an inner housing 11 and an outer housing 12.

The inner housing 11 is a cylindrical member having a motor accommodation space 13 therein, has a circular cross-section around a first central axis C1, and extends along the first central axis C1.

The motor accommodation space 13 is a space having a shape corresponding to the motor 30 to be described below, to accommodate the motor 30.

The inner housing 11 has an open left end and a right end having a cooling fan mounting hole 111, as illustrated in FIG. 1. Herein, the right end of the inner housing 11 includes a few separate components for mounting the motor 30 therein, but a detailed description thereof will not be provided.

The outer housing 12 is a cylindrical member having a circular cross-section around the first central axis C1, and extends along the first central axis C1.

The outer housing 12 has a shape corresponding to the inner housing 11, to surround and accommodate the inner housing 11.

An inner surface of the outer housing 12 and an outer surface of the inner housing 11 are spaced apart from each other by a preset gap to face each other.

The compression unit 20 is a device for sucking in external air and compressing the air, and includes an impeller 21, a front cover 22, and a rear cover 23.

As a major element of a centrifugal pump, the impeller 21 is a wheel including a plurality of curved blades, and is mounted to be rotatable at a high speed.

The front cover 22 is a metal member provided in front of the impeller 21, and includes a compression gas inlet 24 for sucking the external air.

The front cover 22 is provided in the form of a scroll casing having a fluidic channel capable of enabling spiral flow of the air passed through the impeller 21.

The rear cover 23 is a metal member provided behind the impeller 21, and is coupled to the housing 10 by using bolts or screws.

The impeller 21 compresses the air sucked through the compression gas inlet 24, and the air compressed by the impeller 21 is discharged outside through a compression gas outlet 25.

The air sucked through the compression gas inlet 24 is compressed while moving along a compression gas channel 26 connected from the compression gas inlet 24 to the compression gas outlet 25.

The motor 30 is an electric motor for generating rotational force, and is a device for providing high-speed rotational force to the impeller 21. The motor 30 includes a rotary shaft 31, a stator 32, a rotor 33, and bearings 34.

The rotary shaft 31 is a rod member extending along the first central axis C1, and a front end thereof is relatively non-rotatably coupled to the impeller 21 to rotate the impeller 21.

The stator 32 is a stator wound with a field coil, and is mounted and fixed in the motor accommodation space 13.

The rotor 33 is a rotor including a permanent magnet, and is coupled to a middle part of the rotary shaft 31.

The bearings 34 are air bearings rotatably supporting the rotary shaft 31 to reduce friction generated due to high-speed rotation, and are separately provided at a front end and a rear end of the rotary shaft 31.

A preset gap is provided between the stator 32 and the rotor 33, between the rotary shaft 31 and the stator 32, and between the rotary shaft 31 and the bearings 34.

The air-cooling unit 40 is a device for cooling the housing 10 and the motor 30 by using a cooling gas, and includes a cooling gas channel 41 and a cooling fan 42. Herein, air or an inert gas is used as the cooling gas.

The cooling gas channel 41 is a passage containing the cooling gas, and enables continuous circulation of the cooling gas contained therein.

The cooling gas channel 41 passes through the motor accommodation space 13 and the housing 10 as illustrated in FIG. 2, and includes a rear gas channel 41*a*, outer gas channels 41*b*, front gas channels 41*c*, intermediate gas channels 41*d*, and an inner gas channel 41*e*.

The rear gas channel 41*a* is a gas channel for enabling the cooling gas to flow from the center of a rear end of the inner housing 11 in radial directions of the inner housing 11.

The rear gas channel 41*a* has a disc-shaped space provided between an outer surface of the rear end of the inner housing 11 and an inner surface of a rear end of the outer housing 12.

The outer gas channels 41*b* are gas channels penetrating though the housing 10 to cool the housing 10, and extend along the first central axis C1.

The outer gas channels 41*b* are generated by an outer circumferential surface of the inner housing 11, an inner circumferential surface of the outer housing 12, and surfaces of cooling fins 52 to be described below, as illustrated in FIG. 3.

A plurality of outer gas channels 41*b* are arranged along a circumferential direction of the first central axis C1, and are connected to the rear gas channel 41*a*.

The front gas channels 41*c* are gas channels for enabling the cooling gas to flow from the edge toward the center of a front end of the inner housing 11.

The front gas channels 41*c* extend from front ends of the outer gas channels 41*b* to the motor accommodation space 13, and include a plurality of holes 41*c* penetrating though the inner housing 11.

The intermediate gas channels 41*d* extend from middle parts of the outer gas channels 41*b* to the motor accommodation space 13, and include a plurality of holes 41*d* penetrating though the inner housing 11.

The inner gas channel 41*e* is a gas channel passing through a space between the rotary shaft 31 and the stator 32.

The inner gas channel 41*e* is connected to the front gas channels 41*c*, the rear gas channel 41*a*, and the intermediate gas channels 41*d*.

The inner gas channel 41*e* enables the cooling gas to pass by the field coil of the stator 32, the rotary shaft 31, the rotor 33, and the bearings 34.

The cooling gas channel 41 may be rotationally or axially symmetric with respect to the first central axis C1.

In the current embodiment, the cooling gas channel 41 is spatially separate from the compression gas channel 26. Therefore, the air contained in and compressed along the compression gas channel 26 may not leak or permeate into the cooling gas channel 41.

The cooling fan 42 is a cooling fan for forcibly circulating the cooling gas contained in the cooling gas channel 41, and is mounted in the cooling fan mounting hole 111 of the inner housing 11.

In the current embodiment, the cooling fan 42 is relatively non-rotatably coupled to the rear end of the rotary shaft 31, and thus rotates together by rotational force of the rotary shaft 31.

The water-cooling unit 50 is a device for cooling the housing 10 by using a cooling liquid, and includes a cooling water channel 51, the cooling fins 52, a cooling liquid inlet 53, and a cooling liquid outlet 54. Herein, water is used as the cooling liquid.

The cooling water channel 51 is a passage containing the cooling liquid, and enables continuously circulation of the cooling liquid contained therein.

Figure 4:
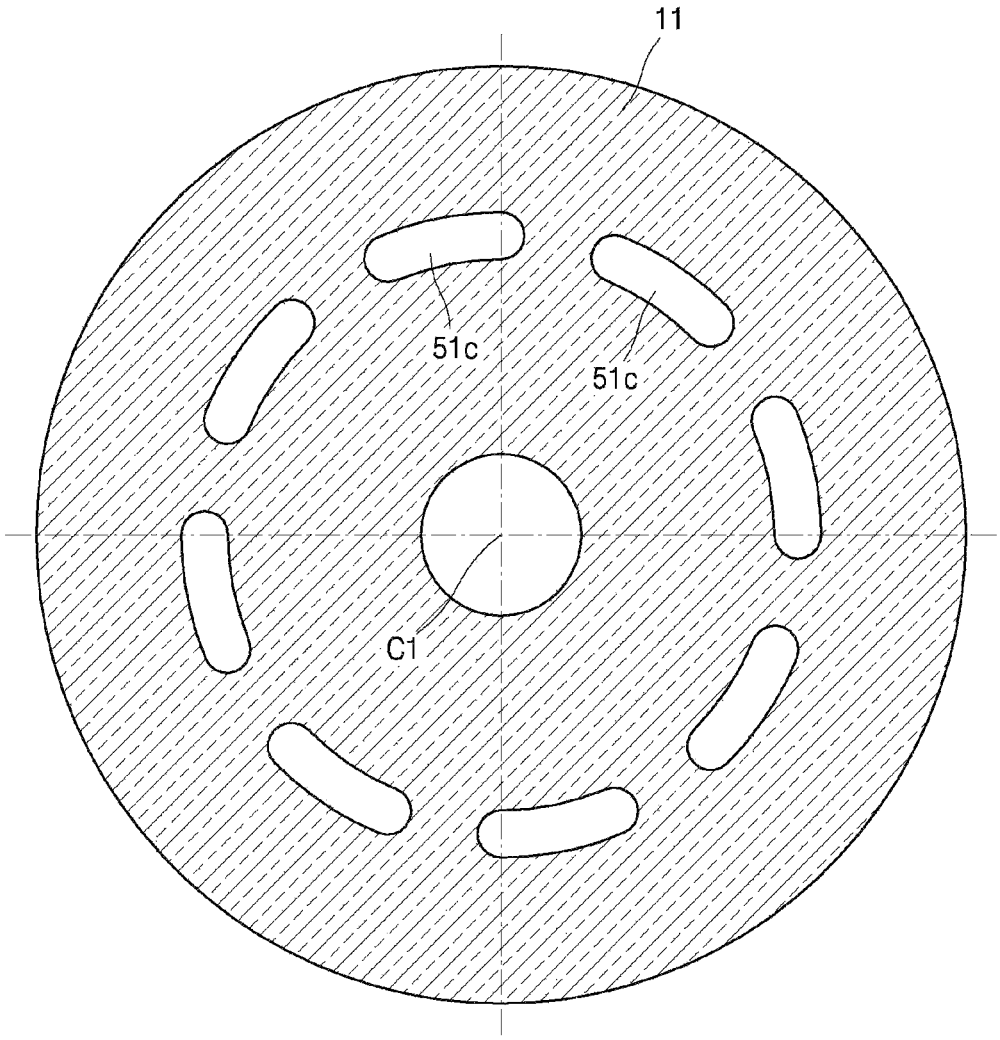
FIG. 4 is a cross-sectional view of the turbo compressor cut along line B-B of FIG. 1.

The cooling water channel 51 penetrates through the inner housing 11 as illustrated in FIGS. 1 and 3, and includes unit water channels 51*a*, rear water channels 51*b* (see FIG. 5), and front water channels 51*c* (see FIG. 4).

The unit water channels 51*a* are circular water channels penetrating through the inner housing 11, and extend along the first central axis C1.

A plurality of unit water channels 51*a* are spaced apart from each other and are arranged along the circumferential direction of the first central axis C1 as illustrated in FIG. 3.

Figure 5:
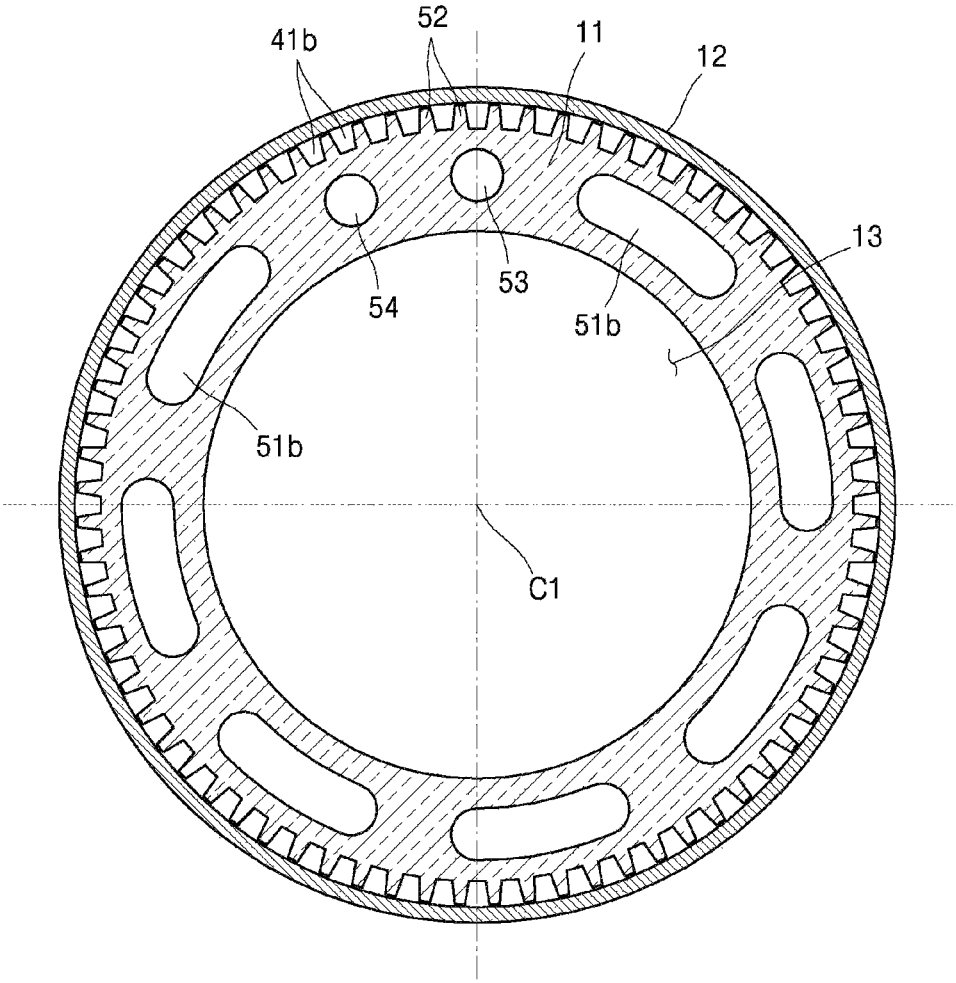
FIG. 5 is a cross-sectional view of the turbo compressor cut along line C-C of FIG. 1.

The rear water channels 51*b* are water channels for interconnecting rear ends of the unit water channels 51*a*, and penetrate through the rear end of the inner housing 11 as illustrated in FIG. 5.

The front water channels 51*c* are water channels for interconnecting front ends of the unit water channels 51*a*, and penetrate through the front end of the inner housing 11 as illustrated in FIG. 4.

Figure 6:
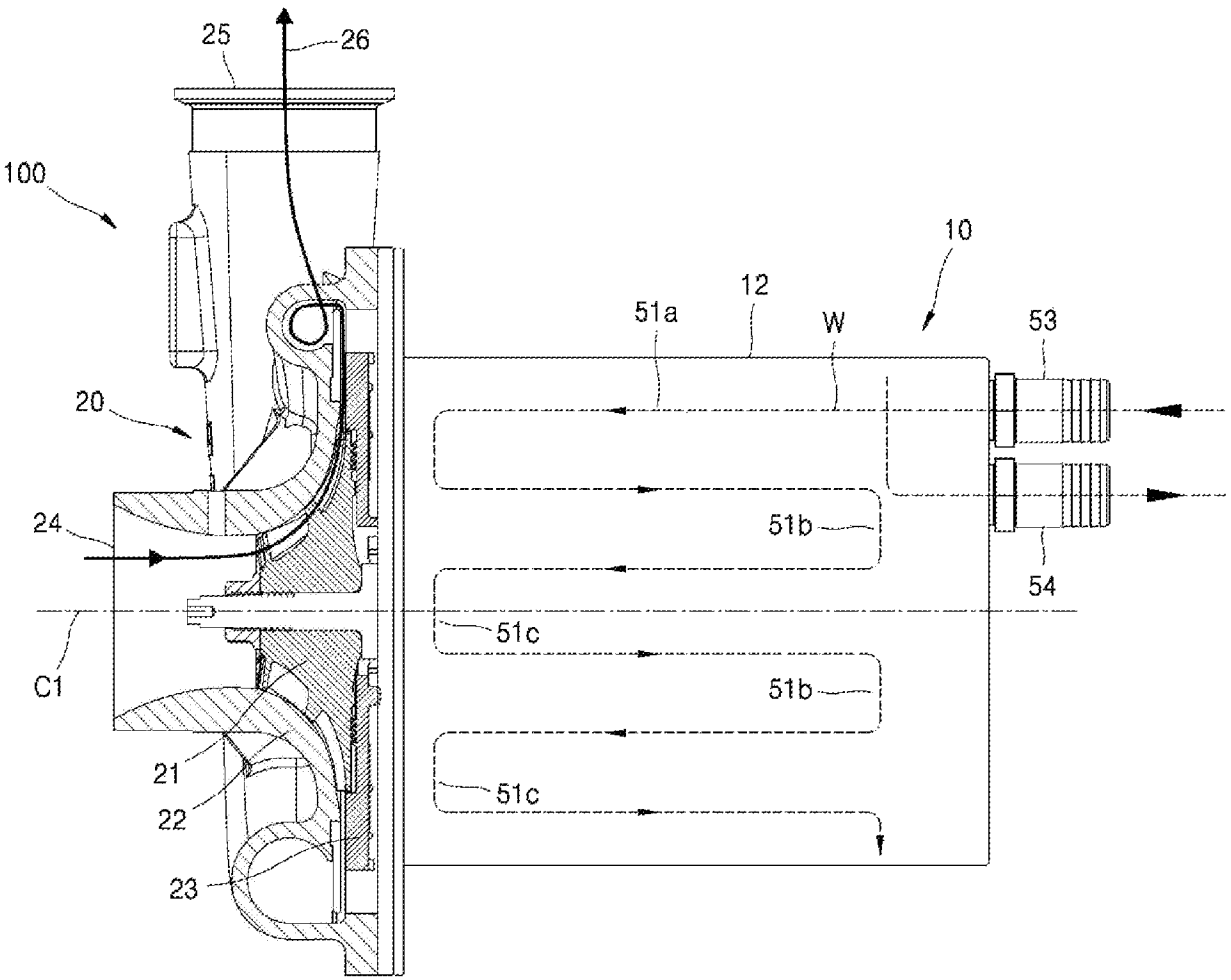
FIG. 6 is a cross-sectional view showing a flow path of a cooling liquid of the turbo compressor illustrated in FIG. 1.

Therefore, the cooling water channel 51 is generated in a zigzag shape along a circumferential direction of the inner housing 11 as illustrated in FIG. 6, and surrounds the whole side wall of the inner housing 11.

The cooling water channel 51 may be rotationally or axially symmetric with respect to the first central axis C1.

The cooling fins 52 are cooling fins for increasing heat exchange efficiency between the cooling liquid flowing along the cooling water channel 51 and the cooling gas flowing along the cooling gas channel 41.

The cooling fins 52 protrude from the outer circumferential surface of the inner housing 11 in radial directions of the inner housing 11 as illustrated in FIGS. 1 and 3, and extend along the first central axis C1.

A plurality of cooling fins 52 are spaced apart from each other and are arranged along the circumferential direction of the inner housing 11.

Ends of the cooling fins 52 are in contact with the inner surface of the outer housing 12.

The cooling liquid inlet 53 is an inlet for receiving the cooling liquid from outside, is connected to an end of the cooling water channel 51, and is provided in the outer housing 12.

The cooling liquid inlet 53 is connected to an external pump (not shown), and thus receives water supplied from the pump.

The cooling liquid outlet 54 is an outlet for discharging the cooling liquid to outside, is connected to the other end of the cooling water channel 51, and is provided in the outer housing 12.

The cooling liquid discharged from the cooling liquid outlet 54 may be cooled outside and then be supplied again through the cooling liquid inlet 53.

An example of an operating method of the above-described turbo compressor 100 will now be described.

When the rotary shaft 31 of the motor 30 rotates, the impeller 21 and the cooling fan 42 rotate, and the air sucked through the compression gas inlet 24 is compressed while flowing along the compression gas channel 26 of the compression unit 20 and is discharged through the compression gas outlet 25. In this case, since the compression gas channel 26 is spatially separate from the cooling gas channel 41, the air flowing in and compressed along the compression gas channel 26 may not leak or permeate into the cooling gas channel 41. That is, a flow path of the air flowing along the compression gas channel 26 is not mixed with a flow path G of the cooling gas flowing along the cooling gas channel 41.

The cooling gas contained in the cooling gas channel 41 is forcibly circulated by the cooling fan 42, and thus passes by the field coil of the stator 32, the rotary shaft 31, the rotor 33, and the bearings 34 as illustrated in FIG. 2.

The cooling liquid contained in the cooling water channel 51 is supplied from the cooling liquid inlet 53, flows along a cooling liquid path W in a zigzag shape along the circumferential direction of the inner housing 11 as illustrated in FIG. 6, cools both the inner and outer housings 11 and 12, and then is discharged through the cooling liquid outlet 54.

In this case, the cooling gas flowing through the outer gas channels 41*b* is rapidly cooled by the cooling liquid flowing through the unit water channels 51*a* adjacent to the outer gas channels 41*b*. Particularly, due to the cooling fins 52, heat exchange efficiency between the cooling liquid flowing through the unit water channels 51*a* and the cooling gas flowing through the outer gas channels 41*b* is very high.

The above-described turbo compressor 100 includes the compression unit 20 including the compression gas inlet 24 for sucking a gas, the impeller 21 for compressing the gas sucked through the compression gas inlet 24, the compression gas outlet 25 for discharging the gas compressed by the impeller 21, and the compression gas channel 26 connected from the compression gas inlet 24 to the compression gas outlet 25, the motor 30 including the rotary shaft 31 having a front end coupled to the impeller 21, to rotate the impeller 21, the housing 10 having the motor accommodation space 13 to accommodate the motor 30, and the cooling gas channel 41 passing through the motor accommodation space 13 and enabling circulation of a cooling gas contained therein. Since the compression gas channel 26 is spatially separate from the cooling gas channel 41 and thus the gas in the compression gas channel 26 does not permeate into the cooling gas channel 41, the motor 30 may be efficiently cooled without pressure loss of the compression unit 20.

In the turbo compressor 100, since the cooling gas channel 41 includes the gas channels 41*a*, 41*b*, 41*c*, and 41*d* penetrating through the housing 10 to cool the housing 10, the housing 10 may be rapidly cooled by using the cooling gas.

Furthermore, since the turbo compressor 100 includes the cooling fan 42 for circulating the cooling gas contained in the cooling gas channel 41, the cooling gas contained in the cooling gas channel 41 may be forcibly circulated.

In the turbo compressor 100, since the cooling fan 42 is provided at a rear end of the rotary shaft 31 and is rotated by rotational force of the rotary shaft 31, an additional motor for rotating the cooling fan 42 may not be required.

Besides, since the turbo compressor 100 includes the cooling water channel 51 for enabling circulation of a cooling liquid therein, an air-cooling function using the cooling gas channel 41 and a water-cooling function using the cooling water channel 51 may be performed at the same time.

In the turbo compressor 100, since the cooling water channel 51 includes the water channels 51*a*, 51*b*, and 51*c* penetrating through the housing 10 to cool the housing 10, compared to a case in which a cooling pipe is separately used, cooling efficiency may be high and the possibility of leakage may be very low.

Furthermore, in the turbo compressor 100, since the cooling water channel 51 is configured to exchange heat with the cooling gas contained in the cooling gas channel 41, a two-stage cooling structure in which the cooling gas heated by the motor 30 may be rapidly cooled by the cooling liquid may be achieved.

In addition, in the turbo compressor 100, since the cooling fins 52 are provided between the cooling water channel 51 and the cooling gas channel 41, heat exchange efficiency between the cooling gas and the cooling liquid may be increased.

Besides, in the turbo compressor 100, since the housing 10 includes the inner housing 11 having the motor accommodation space 13, and the outer housing 12 surrounding the inner housing 11, and the cooling gas channel 41 is provided between an outer surface of the inner housing 11 and an inner surface of the outer housing 12, the cooling fins 52 and the cooling gas channel 41 may be easily generated.

Although the cooling fins 52 are integrated with an outer circumferential surface of the inner housing 11 in the current embodiment, it will be understood that the cooling fins 52 may also be processed as separate members and then be coupled to the housing 10 by using, for example, press fitting.

Figure 7:
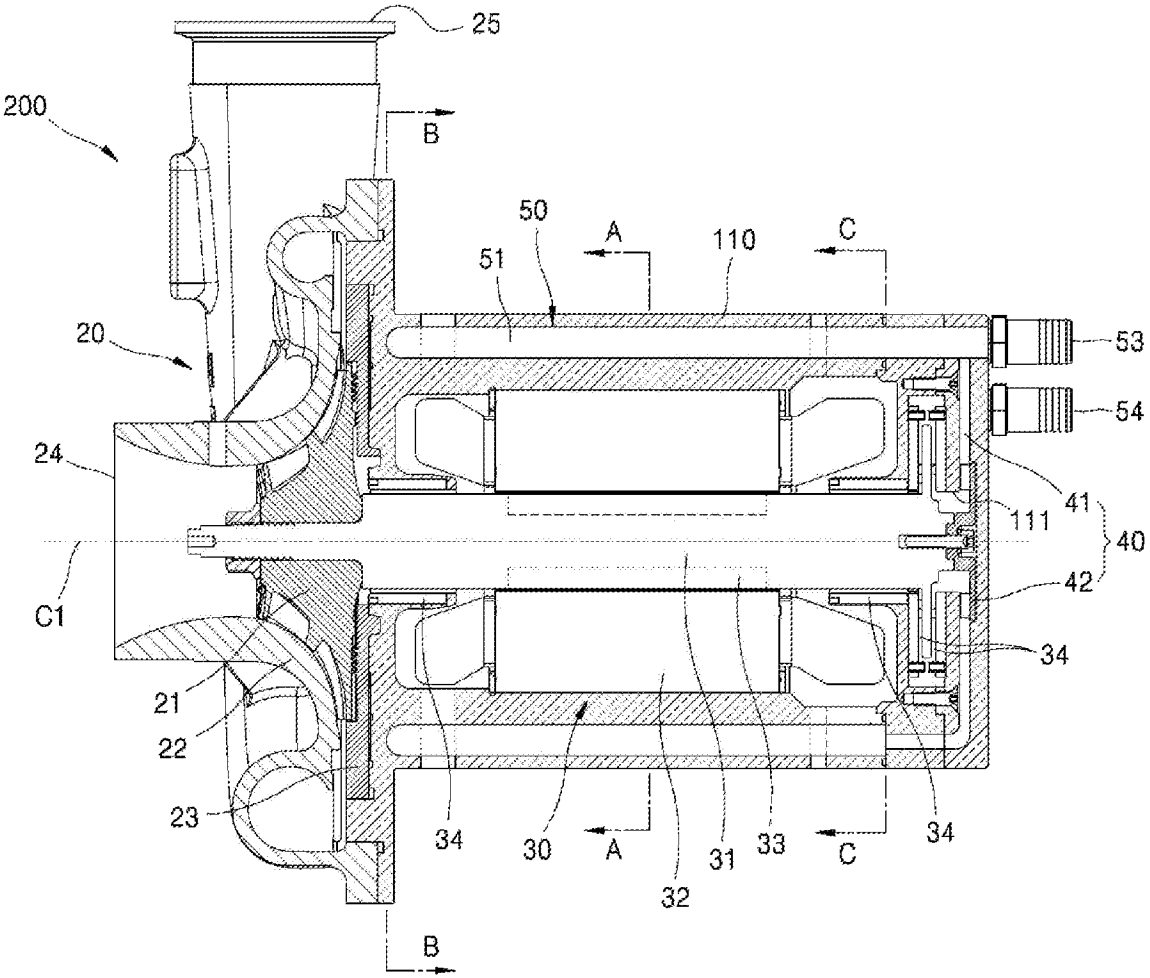
FIG. 7 is a cross-sectional view of a turbo compressor according to a second embodiment of the present invention.

FIG. 7 is a cross-sectional view of a turbo compressor 200 according to a second embodiment of the present invention. Most elements and effects of the turbo compressor 200 are the same as those of the above-described turbo compressor 100 and thus the following description will be focused on the differences therebetween.

The turbo compressor 200 includes a single housing 110 instead of the inner and outer housings 11 and 12.

The unit water channels 51*a* of the turbo compressor 200 extend along a length direction C1 of the rotary shaft 31, and the outer gas channels 41*b* of the turbo compressor 200 extend along the length direction C1 of the rotary shaft 31

Figure 8:
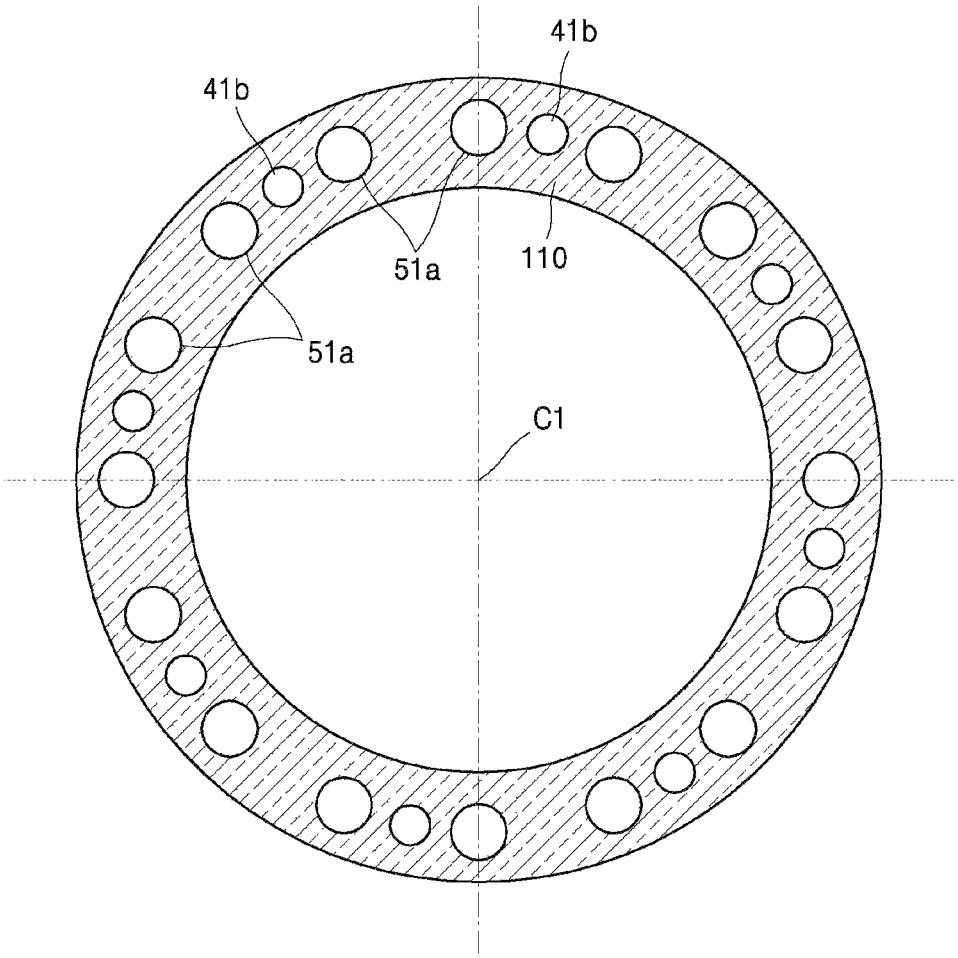
FIG. 8 is a cross-sectional view of the turbo compressor cut along line A-A of FIG. 7.
Figure 9:
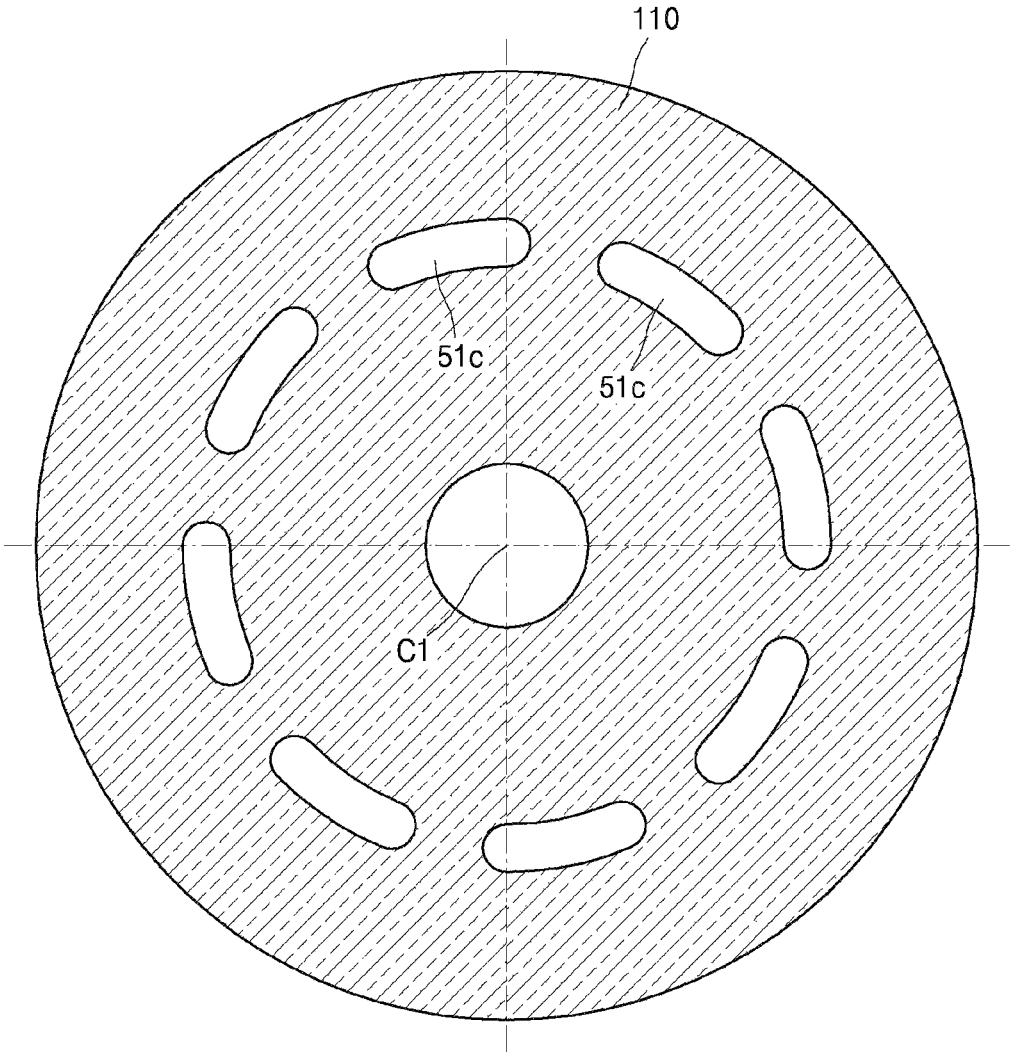
FIG. 9 is a cross-sectional view of the turbo compressor cut along line B-B of FIG. 7.
Figure 10:
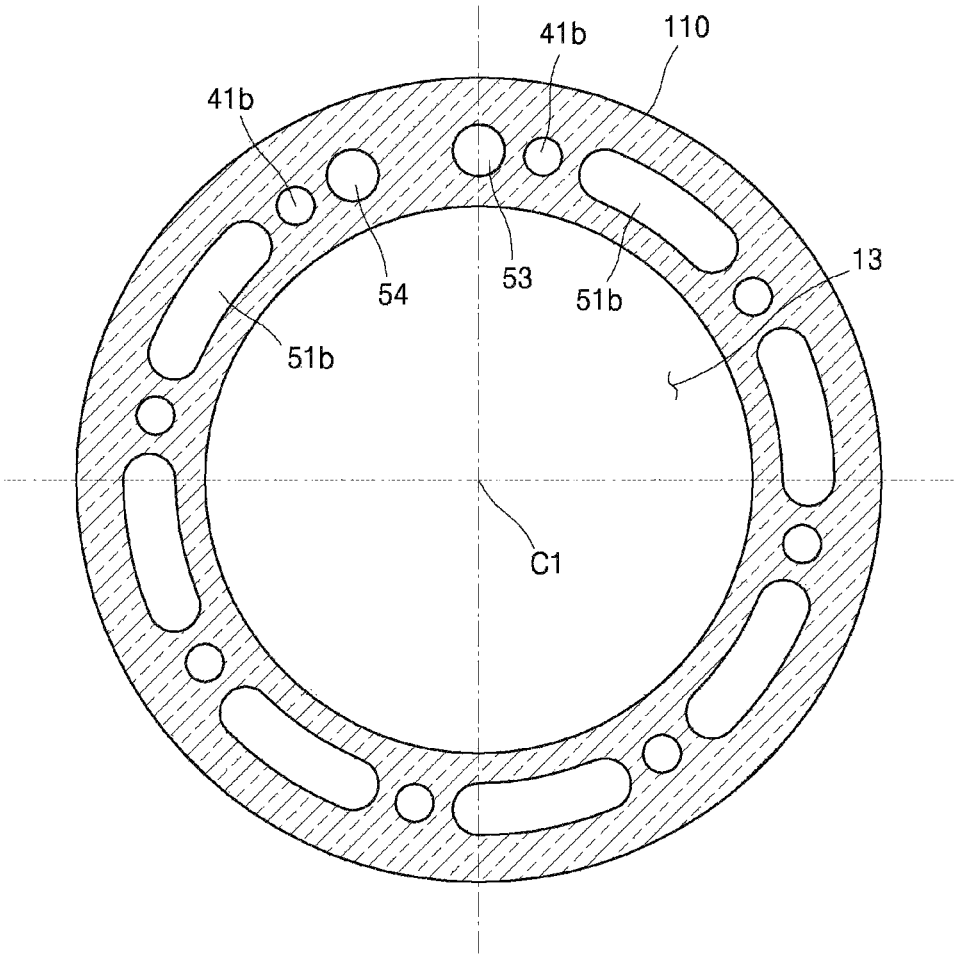
FIG. 10 is a cross-sectional view of the turbo compressor cut along line C-C of FIG. 7.

The unit water channels 51*a* and the outer gas channels 41*b* of the turbo compressor 200 penetrate through the housing 110 and are alternately arranged along a circumferential direction of the rotary shaft 31, as illustrated in FIG. 8.

Since the turbo compressor 200 includes a single housing 110 and the cooling gas channel 41 and the cooling water channel 51 penetrate through the housing 110, the possibility of leakage of a cooling gas and a cooling liquid from the housing 110 may be low.

Although the cooling fan 42 is directly coupled to a rear end of the rotary shaft 31 in the afore-described embodiments, it will be understood that the cooling fan 42 may also be driven by a separate electric motor.

Although the bearings 34 are provided as air bearings in the afore-described embodiments, it will be understood that other types of bearings may also be used.

Although a sealing means for airtightness is not described in the afore-described embodiments, it will be understood that various types of sealing means may be used.

While the present invention has been particularly shown and described with reference to embodiments thereof, it will be understood by one of ordinary skill in the art that various changes in form and details may be made therein without departing from the scope of the present invention as defined by the following claims.

What is claimed is:

1. A turbo compressor for compressing a gas including air and supplying the compressed gas to outside, the turbo compressor comprising:

a compression unit comprising:

a compression gas inlet for sucking the gas;

an impeller for compressing the gas sucked through the compression gas inlet;

a compression gas outlet for discharging the gas compressed by the impeller; and a compression gas channel connected from the compression gas inlet to the compression gas outlet;

a motor comprising a rotary shaft having a front end coupled to the impeller, to rotate the impeller, a stator wound with a field coil, a rotor including a permanent magnet and coupled to a middle part of the rotary shaft, and air bearings rotatably supporting the rotary shaft to reduce friction generated due to high-speed rotation and separately provided at the front end and a rear end of the rotary shaft, a preset gap being provided between the rotary shaft and the air bearings;

a housing having a motor accommodation space to accommodate the motor, wherein the housing comprises an inner housing having the motor accommodation space; and an outer housing surrounding the inner housing;

a cooling gas channel passing through the motor accommodation space and enabling continuous circulation of a cooling gas contained therein;

a cooling fan for continuously circulating the cooling gas contained within the cooling gas channel; and a cooling water channel for enabling circulation of a cooling liquid therein, wherein the compression gas channel is spatially separate from the cooling gas channel and thus the gas in the compression gas channel does not permeate into the cooling gas channel, wherein the cooling gas channel comprises: a rear gas channel having a disc-shaped space provided between an outer surface of a rear end of the inner housing and an inner surface of a rear end of the outer housing; outer gas channels penetrating through the housing to cool the housing, provided between an outer surface of the inner housing and an inner surface of the outer housing, and connected to the rear gas channel; front gas channels extending from front ends of the outer gas channels to the motor accommodation space and including a first plurality of holes penetrating though the inner housing; intermediate gas channels extending from middle parts of the outer gas channels to the motor accommodation space and including a second plurality of holes penetrating though the inner housing; and an inner gas channel passing through a space between the rotary shaft and the stator and connected to the front gas channels and the rear gas channel, the cooling gas passing by the field coil of the stator, the rotary shaft, the rotor, and the air bearings through the inner gas channel and continuously circulating through the rear gas channel, the outer gas channels, the front gas channels, the intermediate gas channels, and the inner gas channel, wherein the cooling fan is provided at a rear end of the rotary shaft opposite to the impeller, is mounted in a cooling fan mounting hole of the inner housing, and is rotated by rotational force of the rotary shaft, wherein the cooling water channel comprises water channels penetrating through the housing to cool the housing, wherein the cooling water channel is configured to exchange heat with the continuously circulating cooling gas contained in the cooling gas channel, wherein the cooling gas is cooled by the cooling liquid flowing through the cooling water channel, wherein the outer gas channels penetrating through the housing and the water channels penetrating through the housing extend along a length direction of the rotary shaft and are alternately arranged along a circumferential direction of the rotary shaft, wherein cooling fins capable of increasing heat exchange efficiency are provided between the cooling water channel and the cooling gas channel.

* * * * *